US009290929B2

(12) United States Patent
Hawk et al.

(10) Patent No.: US 9,290,929 B2
(45) Date of Patent: Mar. 22, 2016

(54) SYSTEM FOR INSTALLING CORNER TRIM WITH A HIDDEN FASTENER

(71) Applicant: Ply Gem Industries, Inc., Cary, NC (US)

(72) Inventors: T. Daniel Hawk, Smithville, MO (US); John M. Wade, Pleasant Hills, MO (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 14/729,552

(22) Filed: Jun. 3, 2015

(65) Prior Publication Data

US 2015/0267398 A1 Sep. 24, 2015

Related U.S. Application Data

(62) Division of application No. 14/162,381, filed on Jan. 23, 2014, now Pat. No. 9,103,127.

(51) Int. Cl.

| | |
|---|---|
| ***E04B 1/41*** | (2006.01) |
| ***E04F 13/073*** | (2006.01) |
| ***E04F 19/02*** | (2006.01) |
| ***E04F 13/18*** | (2006.01) |
| ***E04F 13/08*** | (2006.01) |
| *E04F 13/06* | (2006.01) |
| *E04B 1/38* | (2006.01) |

(52) U.S. Cl.

CPC ..... *E04B 1/40* (2013.01); *E04F 13/0733* (2013.01); *E04F 13/0851* (2013.01); *E04F 13/18* (2013.01); *E04F 19/024* (2013.01); *E04B 2001/405* (2013.01); *E04F 2013/063* (2013.01)

(58) Field of Classification Search

CPC . E04F 2013/063; E04F 19/022; E04F 19/024; E04F 13/0864; E04F 13/0733; E04F 13/18; E04F 13/0851; E04B 1/40; E04B 2001/405

See application file for complete search history.

(56) References Cited

U.S. PATENT DOCUMENTS

| | | | | | |
|---|---|---|---|---|---|
| 1,521,938 | A | * | 1/1925 | Gartenberg | 52/282.1 |
| 2,293,744 | A | * | 8/1942 | Miles et al. | 52/547 |
| 2,904,856 | A | * | 9/1959 | Robinson | 52/255 |
| 2,993,306 | A | * | 7/1961 | Persons | 52/276 |
| 3,304,676 | A | * | 2/1967 | Sallie et al. | 52/276 |
| 3,500,600 | A | * | 3/1970 | Obie, Sr. | 52/58 |
| 3,712,003 | A | * | 1/1973 | Hallock et al. | 52/254 |
| 4,104,839 | A | * | 8/1978 | Balzer et al. | 52/288.1 |
| 4,161,853 | A | * | 7/1979 | Weiss et al. | 52/288.1 |
| 4,189,885 | A | * | 2/1980 | Fritz | 52/287.1 |
| 4,319,439 | A | * | 3/1982 | Gussow | 52/288.1 |
| 4,430,833 | A | * | 2/1984 | Balzer et al. | 52/255 |
| 4,621,471 | A | * | 11/1986 | Kuhr et al. | 52/288.1 |
| 4,638,606 | A | * | 1/1987 | Wendt | 52/36.6 |

(Continued)

OTHER PUBLICATIONS

CertainTeed, "Restoration Millwork," Jan. 2014, 24 pages.

*Primary Examiner* — James Ference

(74) *Attorney, Agent, or Firm* — Lathrop & Gage LLP

(57) ABSTRACT

A system for installing trim installations at external corners of a building includes trim and a bracket. The trim serves both an aesthetic purpose in adding a decorative feature to building envelopes and also adds an additional weatherproofing purpose in allowing for more complete weatherproofing of building envelope corners and openings. The disclosed system relates to a concealed fastening building finishing element system that enables concealed fastening of finishing trim.

10 Claims, 1 Drawing Sheet

(56) References Cited

U.S. PATENT DOCUMENTS

| | | | | | |
|---|---|---|---|---|---|
| 4,689,930 | A * | 9/1987 | Menchetti | 52/277 |
| 4,706,426 | A * | 11/1987 | Rumsey | 52/232 |
| 4,827,683 | A * | 5/1989 | Poole | 52/316 |
| 4,999,961 | A * | 3/1991 | McNary | 52/287.1 |
| 5,313,755 | A * | 5/1994 | Koenig, Jr. | 52/255 |
| 5,542,222 | A * | 8/1996 | Wilson et al. | 52/287.1 |
| 5,740,642 | A * | 4/1998 | Koenig et al. | 52/255 |
| 5,806,253 | A * | 9/1998 | Nelson | 52/179 |
| 5,813,179 | A * | 9/1998 | Koenig et al. | 52/255 |
| D412,673 | S * | 8/1999 | Koenig et al. | D10/64 |
| 5,974,748 | A * | 11/1999 | Sciuga et al. | 52/287.1 |
| 6,041,555 | A * | 3/2000 | Alpi | 52/11 |
| 6,073,406 | A * | 6/2000 | Kearney | 52/287.1 |
| 6,212,836 | B1 * | 4/2001 | Larson | 52/287.1 |
| 6,219,980 | B1 * | 4/2001 | Peck, Jr. | 52/288.1 |
| 6,311,442 | B1 * | 11/2001 | Watanabe | 52/282.3 |
| 6,354,049 | B1 * | 3/2002 | Bennett | 52/287.1 |
| 6,843,032 | B2 * | 1/2005 | Hikai | 52/287.1 |
| 6,883,282 | B1 * | 4/2005 | Newhart, III | 52/287.1 |
| 7,013,610 | B2 * | 3/2006 | Kunz | 52/255 |
| 7,036,282 | B1 * | 5/2006 | Keddell | 52/287.1 |
| 7,214,434 | B2 * | 5/2007 | Dalgleish et al. | 428/537.5 |
| 2002/0083665 | A1 * | 7/2002 | Razetto | 52/288.1 |
| 2003/0121217 | A1 * | 7/2003 | Grizenko | 52/60 |
| 2004/0074175 | A1 * | 4/2004 | Tierney | 52/255 |
| 2005/0193664 | A1 * | 9/2005 | Koenig et al. | 52/287.1 |
| 2006/0059809 | A1 * | 3/2006 | Smythe, Jr. | 52/255 |
| 2006/0207197 | A1 * | 9/2006 | Anderson | 52/211 |
| 2006/0272237 | A1 * | 12/2006 | Koenig et al. | 52/211 |
| 2007/0094996 | A1 * | 5/2007 | Young | 52/716.1 |
| 2008/0066403 | A1 * | 3/2008 | Koenig et al. | 52/255 |
| 2008/0148672 | A1 * | 6/2008 | Monteer | 52/533 |
| 2009/0038247 | A1 * | 2/2009 | Taylor et al. | 52/287.1 |
| 2009/0056252 | A1 * | 3/2009 | Taylor et al. | 52/287.1 |
| 2009/0205279 | A1 * | 8/2009 | Koenig et al. | 52/417 |
| 2009/0235596 | A1 * | 9/2009 | Tyler et al. | 52/287.1 |
| 2010/0088987 | A1 * | 4/2010 | Monteer | 52/302.6 |

* cited by examiner

SYSTEM FOR INSTALLING CORNER TRIM WITH A HIDDEN FASTENER

RELATED APPLICATIONS

This application is a divisional of U.S. application Ser. No. 14/162,381 filed on Jan. 23, 2014.

TECHNICAL FIELD

The present disclosure relates to a system for installing corner trim on a building or structure with a system of brackets that are hidden from view and that obviate the need for cleanup of fastener holes.

BACKGROUND

In the conventional manner of applying corner trim to a building structure the installer has already completed the installation of paneling to the wall and brought the edges of the from the two sides of the corner as close to the corner as time and costs permit. The installer then cuts a first length of trim to be applied in a vertical orientation to the corner to obscure the first side of the corner. The installer then cuts a second piece of trim to length for abutting the first panel which approaches the corner from the opposite side of the building. The principle two principal reasons for securing corner trim to a building is to obscure the gap between the oppositely approaching siding panels and to prevent the intrusion of moisture to surfaces that can be degraded by exposure to moisture. An open gap between the abutting siding lengths may lead to water intrusion underneath the siding that could result in wood rot, mold growth and ultimately structural damage to the building. Moreover, should high speed wind apply back pressure to a siding length at the gap, the resulting pressure on the siding could tear the siding loose from the structure. Additionally, corner trim provides a much more attractive appearance than closely butted siding members and serves to enhance the aesthetic appeal of the structure.

In a typical application described above the installer secures the oppositely approaching boards to the building surface with screws or nails. It is the process of passing nails or screws through the boards into the building structure that depressions are created in the surface where the nails or screws have passed that either are preferably retouched with a water-proof filling compound to create a smooth surface. The filled surface is then painted to create an unblemished appearance. It will be appreciated that these additional steps are time consuming and add additional cost to the installation.

Unfortunately, and particularly in regions of the country where there are temperature extremes and/or high humidity, the hardened water proof filling compound over time is often expunged either partially or fully from the fill hole because of expansion and contraction of the siding panels due to temperature changes or the absorption of moisture that causes the siding boards to swell when damp and contract when ambient moisture recedes. This expungement of the putty creates an unsightly appearance that then requires additional costly maintenance to remedy.

Even when the highest skill level is used to secure the siding boards to the structure small gaps or uneven end cuts can result. This less than desirable outcome can efficiently and cost effectively be remedied with the application of the disclosed corner trim system.

An object of the present invention is to provide trim that can be attached to a building corner in a manner that does not require driving attachment hardware through the front face of the trim.

For the foregoing reasons, there is a need for a trim system utilizing a hidden bracket system that does not require the use of any exposed fasters to secure the trim to the building.

These and other advantages of the invention will be further understood and appreciated by those skilled in the art by reference to the following written specification, claims, and appended drawings. The contents of this summary section are provided only as a simplified introduction to the disclosure, and are not intended to be used to limit the scope of the appended claims.

SUMMARY

This disclosure relates to a concealed fastening building finishing element system that enables concealed fastening of corner trim to an underlying structure. The trim serves both an aesthetic purpose in adding a decorative feature to building envelopes and also adds an additional weatherproofing purpose in allowing for more complete weatherproofing of building envelope corners and openings.

In accordance with one aspect of the disclosure, there is provided a concealed corner trim system including trim members, each trim member having a structure-facing surface and an exterior-facing surface.

The invention advantageously allows the use of standard fastening guns and standard commercially available fasteners. This advantageously results in minimum cost of implementation and minimum additional skills required for installers.

Various objects, features, aspects and advantages of the inventive subject matter will become more apparent from the following detailed description of preferred embodiments, along with the accompanying drawings in which like numerals represent like components. The contents of this summary section are provided only as a simplified introduction to the disclosure, and are not intended to be used to limit the scope of the appended claims.

DETAILED DESCRIPTION

Figure 1:
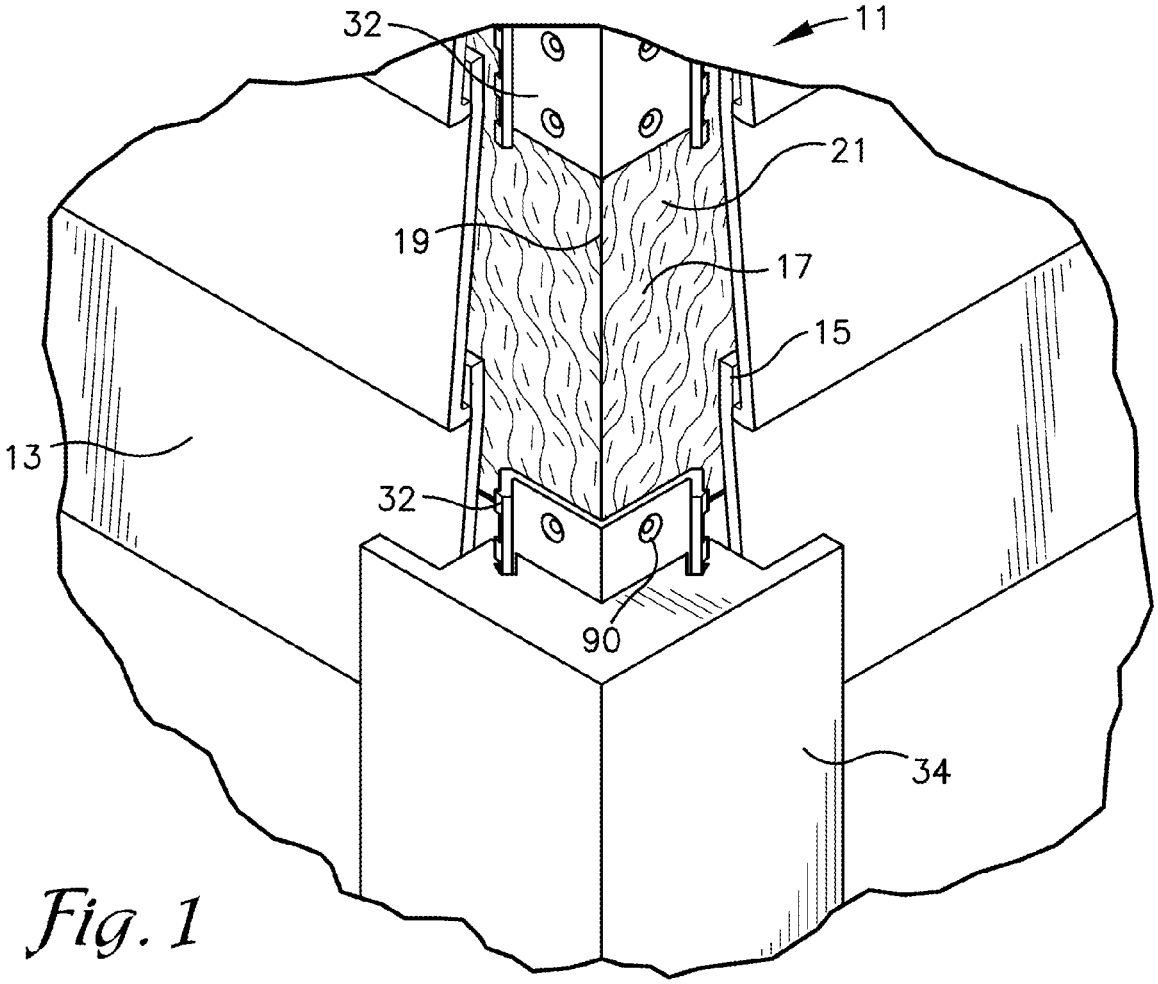
FIG. 1 illustrates an exemplary hidden bracket and a partially completed corner trim member installation in accordance with an exemplary embodiment.

Referring first to FIG. 1, which reveals a building corner 11, siding panels 13 with panel end edges 15 secured in position atop wall materials 17. The wall materials 17 come together at joint 19 forming the corner 11 of the building 21. The hidden bracket corner system 30 shown as partially installed, is comprised of a bracket 32 and trim pieces 34.

Figure 2:
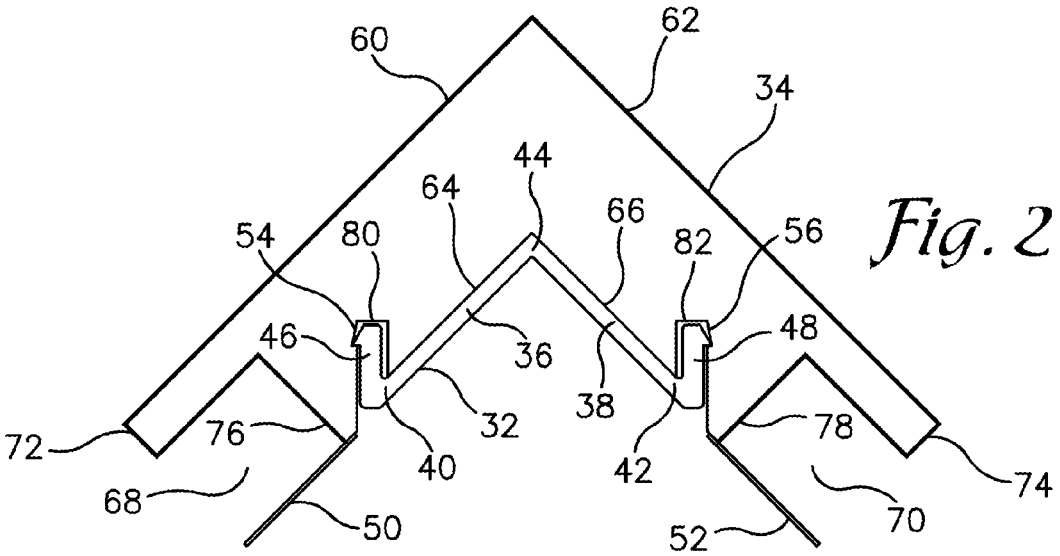
FIG. 2 illustrates a plan view of an exemplary embodiment of a bracket engaged with a trim member.

FIG. 2 reveals an exemplary first embodiment of the bracket and panel system. FIG. 2 illustrates a cross section, or plan view, of the trim piece 34 secured to the bracket 32. The bracket and trim are preferably fabricated from a durable and rigid engineered plastic, or resin; however, metal and ceramic brackets and trim are also contemplated. The bracket 32 is comprised of first and second orthogonally disposed panel elements 36, 38 each with an outboard end 40, 42. The panels are joined at centerline 44. At least one flange 46, 48 extends outwardly from each of the outboard ends 40, 42 of the first and second orthogonally disposed panel elements 36, 38. At least one locking tooth 54, 56 extends outwardly from each of the flanges 46, 48.

FIG. 2 also reveals, in cross section, the trim piece 34 that is attachable to the bracket 32. The trim 34 includes a first and second outer face surface 60, 62, a first and second hidden surface 64, 66 facing the building, and a cutout 68, 70 on each side of the trim piece proximate the first and second hidden surfaces. The cutouts 68, 70 are comprised of overhangs 72, 74 that serve to shield the potentially rough cut edges 15 of the siding panels 13 from view by an onlooker. The overhangs 72, 74 are preferably no thicker than 0.25 inches and extend no further than 0.75 inches from the cutout face surfaces 76, 78. FIG. 2 also reveals at least one longitudinally extending slot 80, 82 disposed within each of the first and second trim piece hidden face surfaces 64, 66 for receiving the at least one flange 46, 48 extending outwardly from the outboard ends 40, 42 of the first and second orthogonally disposed panel elements 36, 38.

The flanges 46, 48 are preferably canted away from the plane of the panel elements 36, 38 at an angle in the range of from 120 to 150 degrees and preferably at 135 degrees. The bracket 32 may optionally include a weather strip 50, 52 that extends outwardly from the hidden surfaces facing the structure 64, 66. The weather stripping 50, 52 serves to prevent the intrusion of moisture beneath the siding panels 13, or trim piece 34, and are flexible yet resilient. The weather stripping 50, 52 may optionally be secured to the trim 34 with an adhesive or formed as part of the fabrication of the trim and preferably extends a distance consistent with the overhangs 72, 74.

In operation, as best seen in FIG. 1, the embodiment of the bracket 32 is positioned over the joint 19 of the building corner 11. The bracket 32 is then secured in position by passing screws or nails through the holes 90 in the orthogonally disposed panel elements 36, 38. Once an appropriate number of brackets 32 are in position atop the building corner 11 the trim piece or pieces 34 may be snapped into position. To accomplish securing the trim 34 to the bracket 32 the trim piece 34 is placed atop the bracket with the longitudinally extending slots 80, 82 of the trim piece aligned with the outwardly extending flanges 46, 48 of the bracket. Sufficient pressure must be applied to the surface of the trim to allow the flanges 46, 48 with their locking teeth 54, 56 to fully traverse to the top of the longitudinally extending slots 80, 82. Once the flanges 46, 48 are inserted into the slots 80, 82 to the desire depth, the trim pieces are secured in position and because the locking teeth will bite into the walls of the slots 80, 82 there will be limited opportunity to reposition the trim 34.

While the preferred form of the present invention has been shown and described above, it should be apparent to those skilled in the art that the subject invention is not limited by the figures and that the scope of the invention includes modifications, variations and equivalents which fall within the scope of the attached claims. Moreover, it should be understood that the individual components of the invention include equivalent embodiments without departing from the spirit of this invention.

It will be understood that certain features and subcombinations are of utility and may be employed without reference to other features and subcombinations and are contemplated within the scope of the claims. Not all steps listed in the various figures need be carried out in the specific order described.

We claim:

1. A bracket system for securing trim to a corner of a building, the bracket system comprising:

(a) at least one bracket that is attachable to a wall, the bracket including:

(i) first and second orthogonally disposed panel elements each with an outboard end;

(ii) at least one flange extending outwardly from each of the outboard ends of the first and second orthogonally disposed panel elements; and (iii) at least one locking tooth extending either of 1) inwardly or 2) outwardly from each of the flanges;

(b) at least one trim piece that is attachable to the bracket, the trim piece including a first outer face surface and a second outer face surface, a first hidden surface facing the building and a second hidden surface facing the building, a first cutout surface extending from the first hidden surface towards the first outer face surface, and a second cutout surface extending from the second hidden surface towards the second outer face surface, the first and second cutout surfaces defining respective sides of the trim piece;

(i) at least one longitudinally extending slot disposed within each of the first and second trim piece hidden surfaces for receiving the at least one flange extending outwardly from the outboard ends of the first and second orthogonally disposed panel elements; and (ii) a first overhang extending from and transverse to the first cutout surface and a second overhang extending from and transverse to the second cutout surface, the first overhang and the first cutout surface defining a first cutout whereby a side edge of a siding element can be slid laterally beneath the first overhang, and the second overhang and the second cutout surface defining a second cutout whereby a side edge of another siding element can be slid laterally beneath the second overhang.

2. The bracket system of claim 1, wherein the at least one flange extending outwardly from each of the outboard ends of the first and second orthogonally disposed panel elements is angled backwards from the plane of the first and second orthogonally disposed panel elements at an angle in the range of 120 to 150 degrees.

3. The bracket system of claim 2, wherein the at least one flange extending outwardly from each of the outboard ends of the first and second orthogonally disposed panel elements is angled backwards from the plane of the first and second orthogonally disposed panel elements at an angle of 135 degrees.

4. The bracket system of claim 1, wherein the first and second orthogonally disposed panel elements are joined at a longitudinally extending centerline.

5. The bracket system of claim 4, wherein each flange extending outwardly from each of the outboard ends of the first and second orthogonally disposed panel elements has an inner face and an outer face.

6. The bracket system of claim 5, wherein the flange inner face faces the centerline and the flange outer face faces away from the centerline.

7. The bracket system of claim 6, wherein the at least one locking tooth extending outwardly from each of the flanges preferably extends outwardly from the outer face.

8. The bracket system of claim 6, wherein the at least one outwardly facing locking tooth is for engagement with an interior surface of the longitudinally extending slot disposed within each of the first and second trim piece surfaces.

9. The bracket system of claim 1, wherein at least one through hole is disposed within each of the first and second orthogonally disposed panel elements for purposes of passing a bracket securing device into the building structure.

10. The bracket system of claim 1, wherein the at least one bracket and the at least one trim piece are fabricated from a material comprising plastic.

* * * * *